US011719079B2

(12) United States Patent
Watkins et al.

(10) Patent No.: US 11,719,079 B2
(45) **Date of Patent: *Aug. 8, 2023**

(54) NON-MECHANICAL PORTED PERFORATING TORCH

(71) Applicant: CHAMMAS PLASMA CUTTERS LLC, Houston, TX (US)

(72) Inventors: Todd Joseph Watkins, Houston, TX (US); Jian Zhang, Jersey Village, TX (US); Michel Chammas, Houston, TX (US)

(73) Assignee: CHAMMAS PLASMA CUTTERS LLC, Houston, TX (US)

( * ) Notice: Subject to any disclaimer, the term of this patent is extended or adjusted under 35 U.S.C. 154(b) by 21 days.

This patent is subject to a terminal disclaimer.

(21) Appl. No.: 17/492,191

(22) Filed: Oct. 1, 2021

(65) Prior Publication Data

US 2022/0106861 A1 Apr. 7, 2022

Related U.S. Application Data

(60) Provisional application No. 63/212,299, filed on Jun. 18, 2021, provisional application No. 63/087,080, filed on Oct. 2, 2020.

(51) Int. Cl.

| | |
|---|---|
| ***E21B 34/06*** | (2006.01) |
| ***E21B 43/1185*** | (2006.01) |
| ***E21B 43/119*** | (2006.01) |

(52) U.S. Cl.

CPC ..... *E21B 43/1185* (2013.01); *E21B 34/063* (2013.01); *E21B 43/119* (2013.01)

(58) Field of Classification Search

CPC .... E21B 29/02; E21B 34/063; E21B 43/1185; E21B 43/119

See application file for complete search history.

(56) References Cited

U.S. PATENT DOCUMENTS

| | | | | |
|---|---|---|---|---|
| 3,076,507 | A * | 2/1963 | Sweetman | E21B 29/02 166/376 |
| 3,713,636 | A * | 1/1973 | Helms | F23B 7/00 266/71 |
| 5,435,394 | A * | 7/1995 | Robertson | E21B 29/02 166/382 |
| 6,513,602 | B1 * | 2/2003 | Lewis | A62C 5/006 169/84 |
| 6,598,679 | B2 * | 7/2003 | Robertson | E21B 29/02 166/297 |
| 6,925,937 | B2 * | 8/2005 | Robertson | E21B 29/02 102/202 |
| 7,690,428 | B2 * | 4/2010 | Robertson | E21B 43/11 166/63 |
| 9,677,364 | B2 * | 6/2017 | Tallini | F42D 1/045 |

(Continued)

FOREIGN PATENT DOCUMENTS

WO WO-2020169977 A1 * 8/2020

*Primary Examiner* — Daniel P Stephenson
(74) *Attorney, Agent, or Firm* — Ewing & Jones, PLLC

(57) ABSTRACT

A perforating torch includes a thermal igniter assembly, a compressed grain magazine, and a perforating head assembly. The compressed grain magazine is coupled to the thermal igniter. The perforating head assembly includes a port. A port plug may be positioned in the port. A rupture disc may be positioned between the compressed grain magazine and the perforating head.

22 Claims, 11 Drawing Sheets

(56) References Cited

U.S. PATENT DOCUMENTS

| | | | | |
|---|---|---|---|---|
| 10,781,676 | B2 * | 9/2020 | Huang | E21B 43/1185 |
| 2008/0296021 | A1 * | 12/2008 | Robertson | E21B 29/02 166/298 |
| 2014/0262270 | A1 * | 9/2014 | Robertson | E21B 47/09 166/55 |
| 2019/0186243 | A1 * | 6/2019 | Huang | E21B 43/1185 |
| 2020/0023805 | A1 * | 1/2020 | Hiraoka | F42B 3/24 |
| 2022/0034183 | A1 * | 2/2022 | Watkins | E21B 29/02 |
| 2022/0106861 | A1 * | 4/2022 | Watkins | E21B 43/1185 |

* cited by examiner

NON-MECHANICAL PORTED PERFORATING TORCH

CROSS-REFERENCE TO RELATED APPLICATIONS

This application is a nonprovisional application which claims priority from U.S. provisional application No. 63/087,080, filed Oct. 2, 2020, and U.S. Provisional Application No. 63/212,299, filed Jun. 18, 2021, each of which is hereby incorporated by reference herein in its entirety.

TECHNICAL FIELD/FIELD OF THE DISCLOSURE

The present disclosure relates generally to downhole tools, and specifically to downhole perforating torches.

BACKGROUND OF THE DISCLOSURE

When drilling a subterranean wellbore for the purpose of obtaining petroleum, natural gas, water, and other underground resources, it is sometimes necessary to cut and retrieve pipe or casing during drilling and production operations when unwanted circumstances occur. It is also common to perforate the well casing or production tubing. Some reasons for perforating are concrete squeezes, recirculation of the well, and emptying of fluid from the production tubing during service work. However, perforation or cutting operations may swell, crack, or otherwise deform the pipe. Explosive cutters may also leave debris in the wellbore after the cut, which may cause difficulties with pipe retrieval. Thermal perforating torches had been developed to burn through the pipe, allowing for a clean cut. However, in high pressure oil and gas wells, drilling fluids known as mud, are pumped into the well, allowing for pressure control and circulation of the drill cuttings. The drilling mud may interfere with mechanical moving parts of current thermal perforating torch designs.

SUMMARY

The present disclosure provides for a perforating torch. The perforating torch may include a thermal igniter assembly. The perforating torch may include a compressed grain magazine coupled to the thermal igniter. The perforating torch may include a perforating head assembly, the perforating head assembly including a port.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
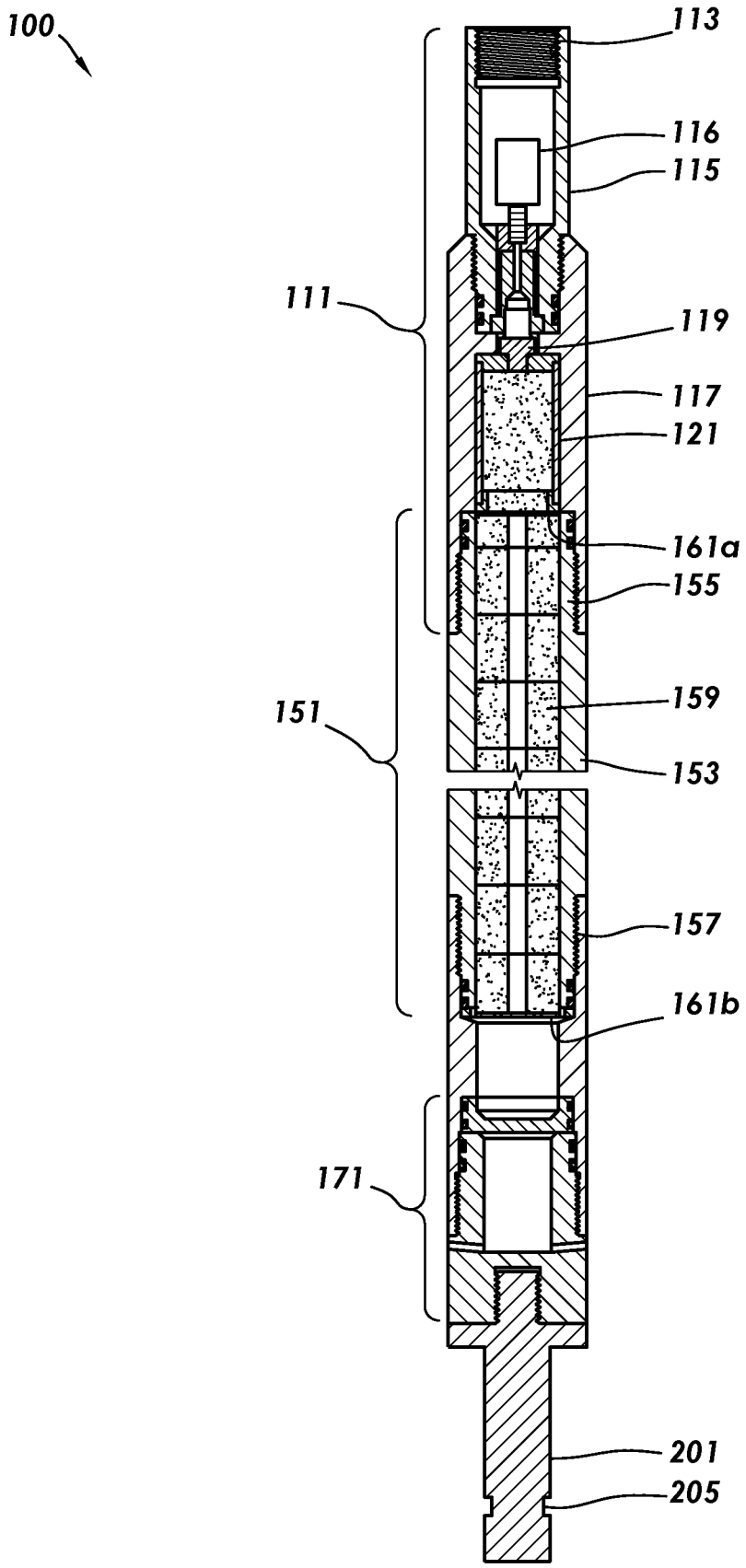
FIG. 1 depicts a cross section view of a perforating torch consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

For the purposes of the present disclosure, the terms "upper," "upward," and "above" refer to the relative direction as within a wellbore in a direction toward the surface regardless of the orientation of the wellbore. For the purposes of this disclosure, the terms "lower," "downward," and "below" refer to the relative direction as within a wellbore in a direction away from the surface regardless of the orientation of the wellbore.

FIG. 1 depicts a cross section view of perforating torch 100 consistent with at least one embodiment of the present disclosure. Perforating torch 100 may be positioned within a wellbore. In some embodiments, perforating torch 100 may be positioned in the wellbore by wireline, slickline, on a tubing string, or on a tubular string. Perforating torch 100 may be used to perforate or sever tubing or casing within which perforating torch 100 is positioned as discussed further below.

In some embodiments, perforating torch 100 may include thermal igniter assembly 111, compressed grain magazine 151, perforating head assembly 171, and anchor base 201. In some embodiments, such as those in which thermal igniter assembly 111 is positioned at an upper end of perforating torch 100, thermal igniter assembly 111 may include upper coupler 113 positioned to allow perforating torch 100 to couple to a wireline, slickline, tubing string, or tubular string.

Figure 2:
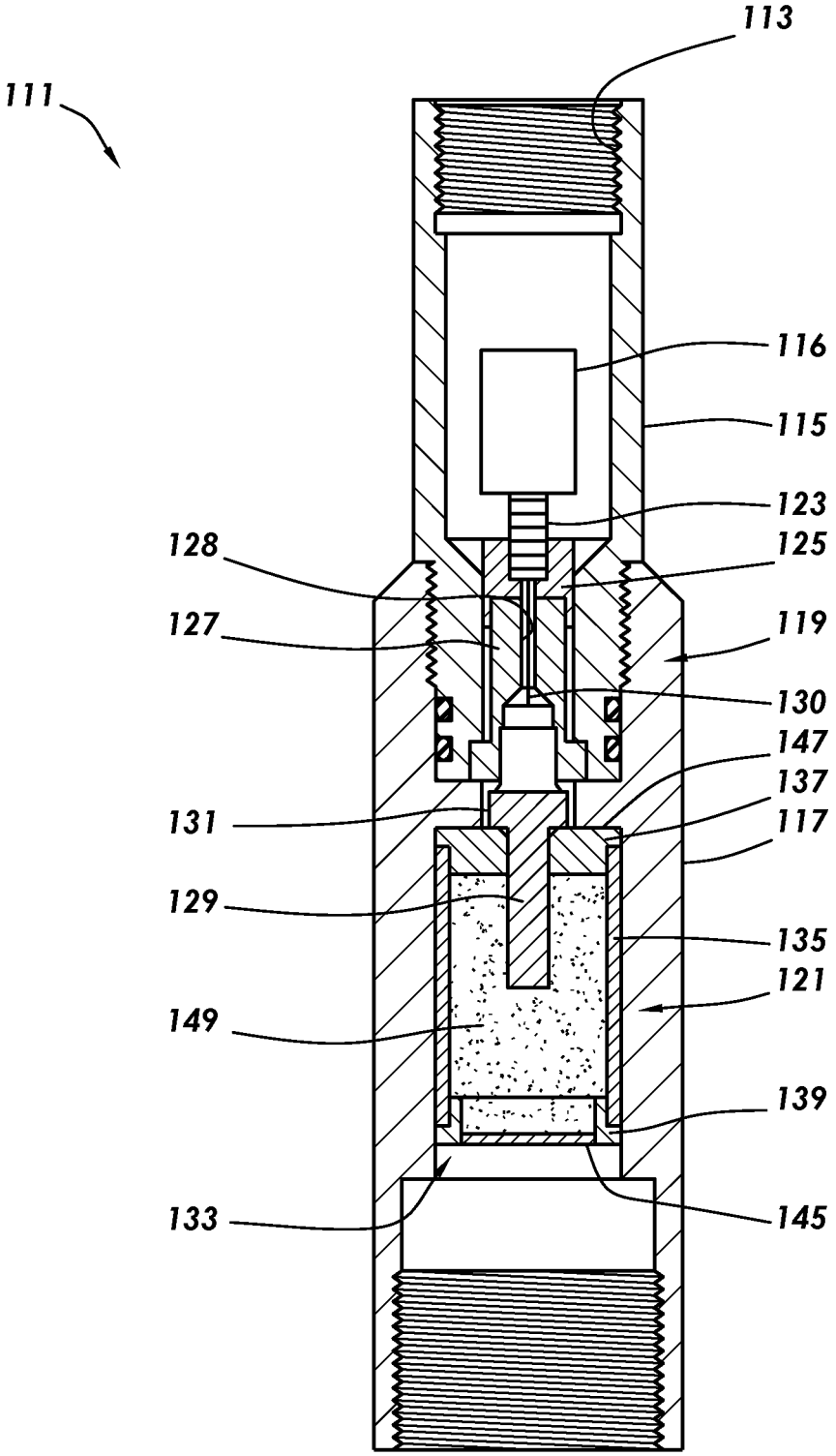
FIG. 2 depicts a cross section view of a thermal igniter and a thermal cartridge of a perforating torch consistent with at least one embodiment of the present disclosure.
Figure 3:
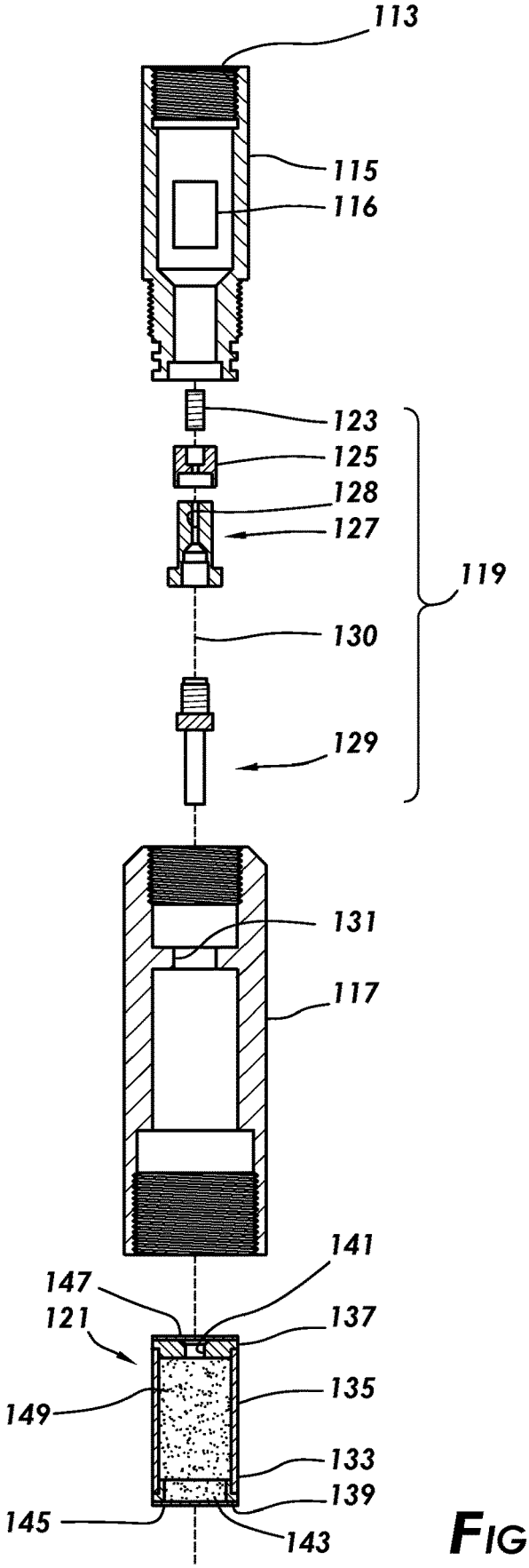
FIG. 3 depicts an exploded view of the thermal igniter of FIG. 2.
Figure 4:
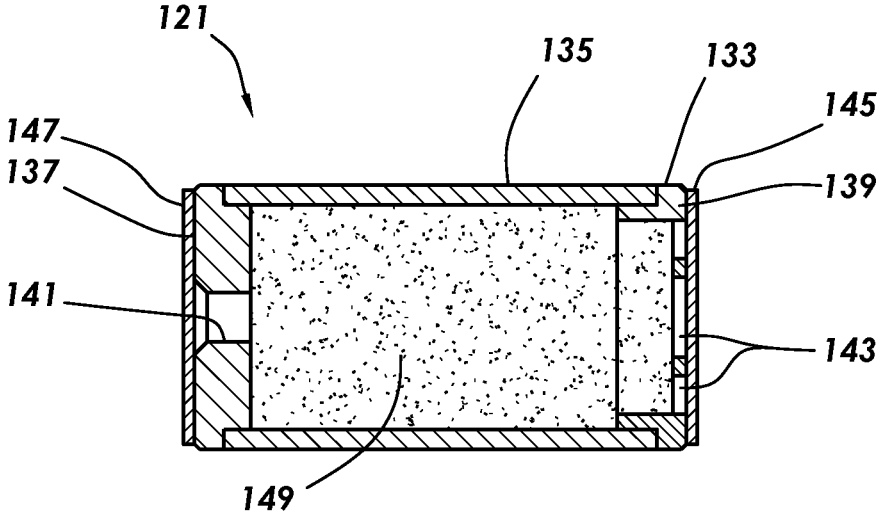
FIG. 4 depicts a cross section view of the thermal cartridge of FIG. 2.

In some embodiments, with reference to FIGS. 2-4, thermal igniter assembly 111 may include electrical sub 115, cartridge containment sub 117, thermal igniter 119, and thermal cartridge 121. Electrical sub 115 may, in some embodiments, be substantially tubular and may be used to house electronic components 116 used to power and operate perforating torch 100. In some embodiments, electrical sub 115 may be mechanically coupled to cartridge containment sub 117, which may itself be tubular.

In some embodiments, thermal igniter 119 may be used to initiate operation of perforating torch 100 as further discussed below. In some embodiments, with reference to FIG. 3, thermal igniter 119 may include spring 123. Spring 123 may be used to provide electrical contact between electronic components 116 and thermal igniter 119. Spring 123 may seat into insulation cap 125. Insulation cap 125 may be formed from a material that is electrically insulative, such that insulation cap 125 prevents electrical contact between spring 123 and cartridge containment sub 117.

In some embodiments, thermal igniter 119 may include heater stem 127. Insulation cap 125 may seat into heater stem 127. Heater stem 127 may include axial hole 128 through which conductor 130 may pass. Heater stem 127 may mechanically couple to cartridge containment sub 117. Heater stem 127 may provide sufficient seal against cartridge containment sub 117 to contain pressure experienced within perforating torch 100 during operation of perforating torch 100.

Thermal igniter 119 may include heating coil assembly 129. Heating coil assembly 129 may be mechanically coupled to heater stem 127. Heating coil assembly 129 may extend through igniter aperture 131 formed in cartridge containment sub 117. Heating coil assembly 129 may extend into the interior of thermal cartridge 121. Heating coil assembly 129 may include a heating coil adapted to, when electrically activated, provide sufficient heat to ignite thermal cartridge 121 as discussed below. In some embodiments, the heating coil of heating coil assembly 129 may be formed from tungsten wire.

Figure 4A:
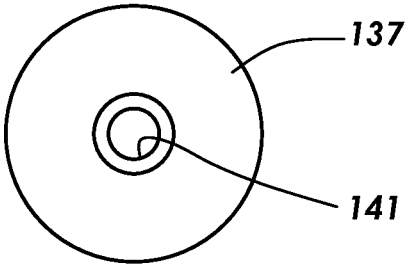
FIG. 4A depicts a top view of the thermal cartridge of FIG. 4.
Figure 4B:
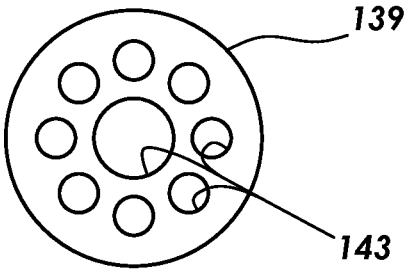
FIG. 4B depicts a bottom view of the thermal cartridge of FIG. 4.

In some embodiments, with reference to FIG. 4, thermal cartridge 121 may include cartridge housing 133. Cartridge housing 133 may be configured to fit into cartridge containment sub 117 such that heating coil assembly 129 extends at least partially into thermal cartridge 121. Cartridge housing 133 may include outer housing 135, top cap 137, and bottom cap 139. Top cap 137 may, as shown in FIG. 4A, include center hole 141 positioned to allow heating coil assembly 129 to extend through top cap 137. In some embodiments, with reference to FIG. 4B, bottom cap 139 may include one or more holes 143. In some embodiments, one or more of holes 143 may be arranged in a circular pattern through bottom cap 139. In some embodiments, referring to FIG. 4, holes 143 of bottom cap 139 may be sealed by lower seal 145, which may, for example and without limitation, be a film such as a piece of aluminum adhesive backed tape. In some embodiments, during shipping or transport or otherwise before thermal cartridge 121 is assembled to heating coil assembly 129, upper seal 147 may be affixed to top cap 137, which may, for example and without limitation, be a film such as a piece of aluminum adhesive backed tape. During assembly, heating coil assembly 129 may pierce upper seal 147 as heating coil assembly 129 enters thermal cartridge 121.

Thermal cartridge 121 may include nonexplosive combustible material 149 positioned within cartridge housing 133. In some embodiments, nonexplosive combustible material 149 may be powdered thermite. Nonexplosive combustible material 149 may be adapted to combust in response to activation and subsequent heating of heating coil assembly 129. As nonexplosive combustible material 149 combusts, molten combustible material may penetrate through seal 145 and exit thermal cartridge 121 and may be used to activate perforating torch 100 as discussed further below. In some embodiments, nonexplosive combustible material 149 may be in the form of loose powder.

Figure 5:
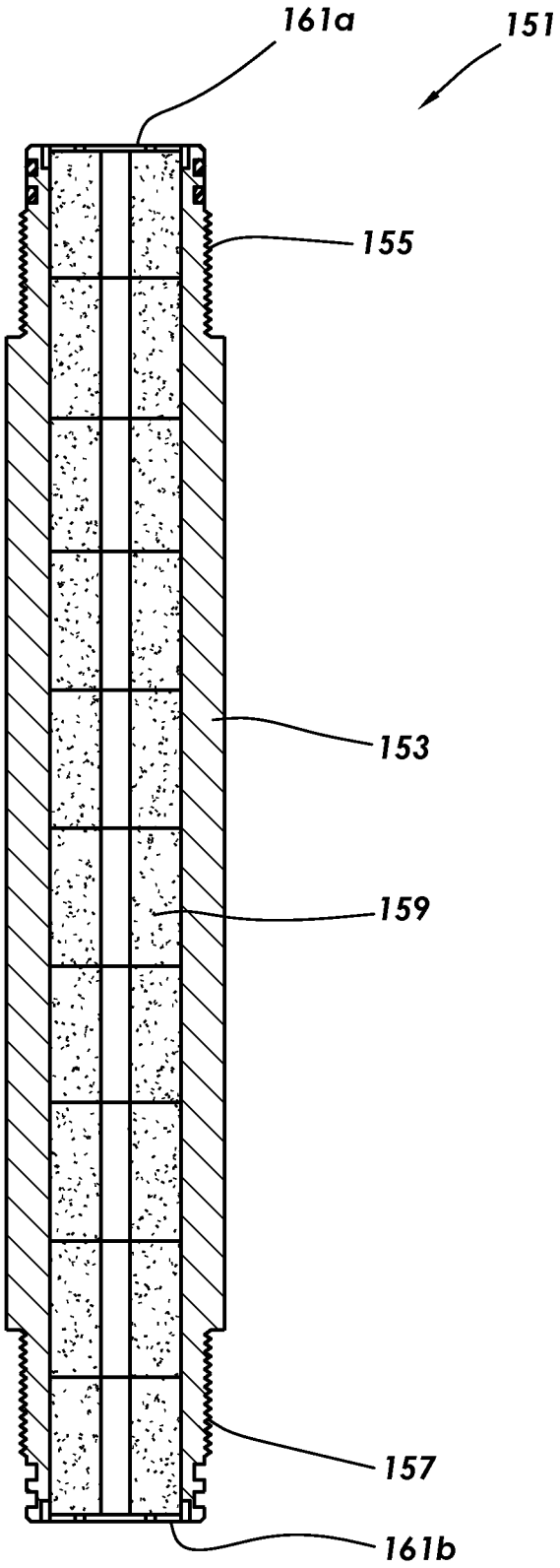
FIG. 5 depicts a cross section view of a compressed grain magazine of a perforating torch consistent with at least one embodiment of the present disclosure.

In some embodiments, with reference to FIG. 1, cartridge containment sub 117 may be mechanically coupled to compressed grain magazine 151. As shown in FIG. 5, compressed grain magazine 151 may include magazine housing 153, which may be tubular and may include upper coupler 155 adapted to couple to cartridge containment sub 117 and may include lower coupler 157 adapted to couple to perforating head assembly 171 as further described below.

Figure 5A:
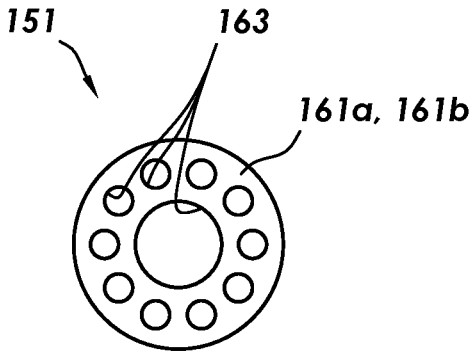
FIG. 5A depicts an end view of a compression disc consistent with at least one embodiment of the present disclosure.

In some embodiments, compressed grain magazine 151 may include compressed nonexplosive combustible material 159 positioned within magazine housing 153. In some embodiments, compressed nonexplosive combustible material 159 may be thermite. In some embodiments, compressed nonexplosive combustible material 159 may be contained within magazine housing 153 by compression discs 161*a*, 161*b* positioned on either end of magazine housing 153. In some embodiments, compression discs 161*a*, 161*b* may be press-fit into magazine housing 153. As shown in FIG. 5A, compression discs 161*a*, 161*b* may include one or more compression disc holes 163. Compression disc holes 163 may allow molten combustible material to pass through compression discs 161*a*, 161*b* during activation of perforating torch 100. For example, compression disc 161*a*, positioned at an upper end of compressed grain magazine 151 may allow molten combustible material from thermal cartridge 121 to pass into compressed grain magazine 151 such that compressed nonexplosive combustible material 159 may be ignited. Similarly, compression disc 161*b*, positioned at the lower end of compressed grain magazine 151, may allow molten combustible material from compressed grain magazine 151 to pass into perforating head assembly 171 as further discussed below.

Figure 5B:
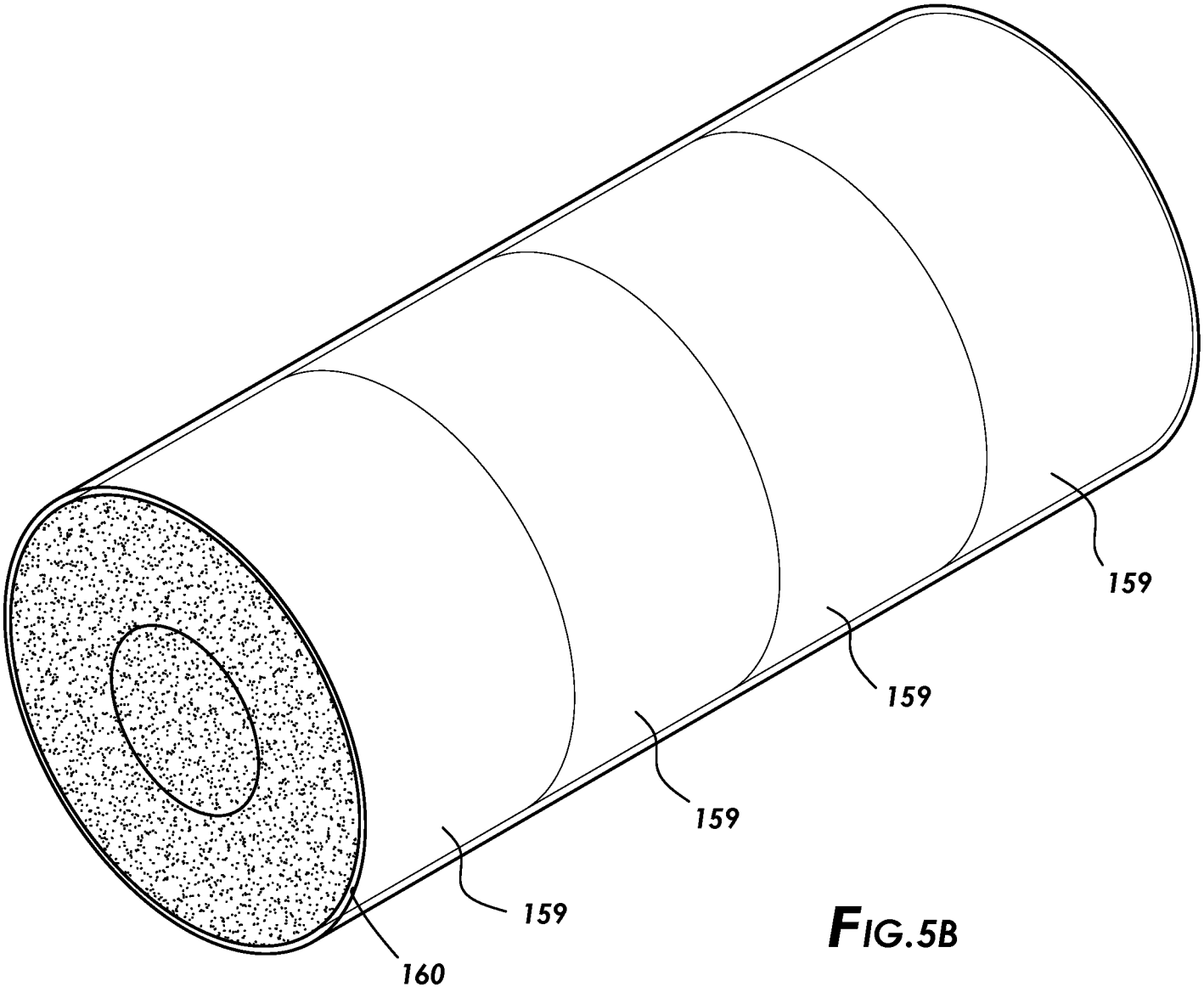
FIG. 5B is a perspective view of compressed nonexplosive combustible material of a compressed grain magazine consistent with at least one embodiment of the present disclosure.

In some embodiments, as shown in FIG. 5B, compressed nonexplosive combustible material 159 may be provided wrapped in film 160. Film 160 may be used to connect and hold together multiple elements or pellets of compressed nonexplosive combustible material 159 such as, for example and without limitation, for transport or for simplification of loading in to compressed grain magazine 151. In some embodiments, film 160 may be formed from fluorinated ethylene propylene or other material. In some embodiments, film 160 may be a shrink wrap film or shrink tubing. In some embodiments, pyrotechnic performance of compressed nonexplosive combustible material 159 may be enhanced by, without being bound to theory, creating a delay in the burn rate of the outer circumferential area of compressed nonexplosive combustible material 159. This delay may help ensure that compressed nonexplosive combustible material 159 burns from the internal central axial hole first, which may enhance the cutting or perforation ability of perforating torch 100 while reducing the production of excessive gas pressure that may result in tool movement hindering its cutting or perforating ability. While described herein with respect to a perforating torch, one of ordinary skill in the art with the benefit of this disclosure will understand that compressed nonexplosive combustible material 159 wrapped in film 160 may be used in any other device that employs compressed nonexplosive combustible material 159 as described herein.

FIGS. 6, 6A, 6B, 6C depict perforating head assembly 171 which connects to the compressed grain magazine 151. Perforating head assembly 171 may be made from refractory metal or alloys of refractory metals. Perforating head assembly 171 may be machined with one or more O-ring grooves 173 that hold one or multiple O-rings in place in order to seal external pressure from entering the tool. Perforating head assembly 171 may include male threads 175 allowing perforating head assembly 171 to be connected to compressed grain magazine 151. In some embodiments, perforating head assembly 171 may include one or more horizontal or angled holes referred to as ports 179 spaced 180 degrees apart. In other embodiments, multiple ports 179 may be formed in perforating head assembly 171 according to desired perforating or cutting effect. Each individual port 179 may be perpendicular to the length of perforating head assembly 171 or may be angled toward the top of perforating torch 100 in order to provide a counter pressuring effect that acts to stabilize the tool when activated. In some embodiments, the base of perforating head assembly 171 may include a hole with female threads 181, which may be used to attach anchor base 201. In some embodiments, for example and without limitation, ports 179 may be angled up to 45 degrees toward the top of perforating torch 100.

Figure 6:
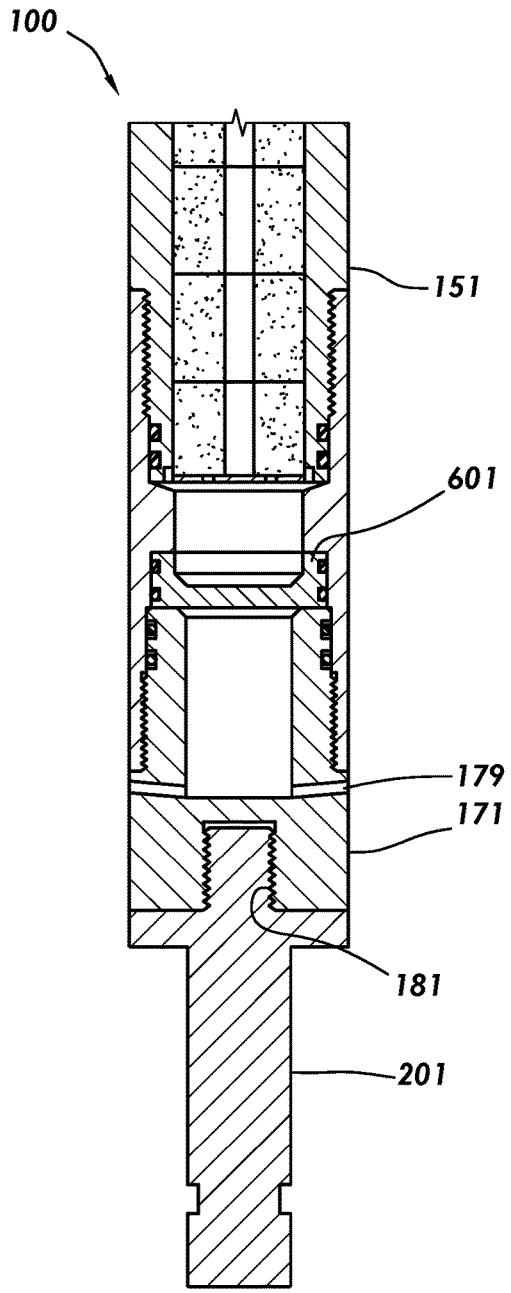
FIG. 6 is a cross section view of a perforating torch consistent with at least one embodiment of the present disclosure.
Figure 6A:
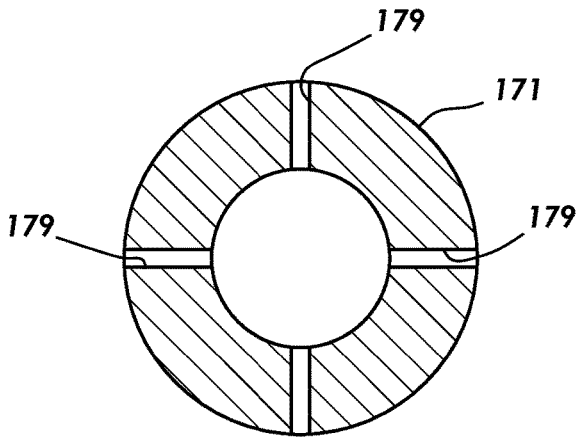
FIG. 6A is a cross section view of the perforating torch of FIG. 6.
Figure 6B:
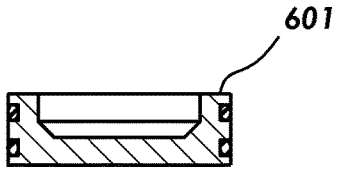
FIG. 6B is a cross section view of a rupture disc consistent with at least one embodiment of the present disclosure.

In some embodiments, as shown in FIGS. 6, 6B perforating head assembly 171 may include rupture disc 601. Rupture disc 601 may be formed from a non-refractory material. Rupture disc 601 may be positioned between the interior of perforating head assembly 171 and compressed grain magazine 151. In some such embodiments, perforating head assembly 171 may be allowed to fill with wellbore fluids as further discussed below.

In some embodiments, when intact, rupture disc 601 may fluidly separate the interior of perforating torch 100 that incudes compressed grain magazine 151 from the interior of perforating head assembly 171. Rupture disc 601 may be formed from a material and may have a geometry selected such that rupture disc 601 remains intact until the pressure within compressed grain magazine 151 is above a selected threshold pressure, at which time rupture disc 601 fails mechanically, opening the flow path for molten combustible material to enter and traverse perforating head assembly 171 and exit ports 179, thereby allowing the high pressure molten combustible material to exit perforating torch 100 and cut or perforate the tube or casing within which perforating torch 100 is positioned.

In such an embodiment, because ports 179 are not obstructed, the resultant jet of molten combustible material exiting through ports 179 may, for example and without limitation, be more uniform than an embodiment in which an obstruction is positioned in or about ports 179.

Additionally, in some such embodiments, wellbore fluid may enter perforating head assembly 171 through ports 179. In such an embodiment, upon activation of perforating torch 100, wellbore fluid within perforating head assembly 171 may be expelled from perforating head assembly 171. As the molten combustible material enters perforating head assembly 171 after breaking through rupture disc 601, the molten combustible material forces the wellbore fluid within perforating head assembly 171 to be expelled through ports 179. This expulsion may, without being bound to theory, reduce shock energy experienced by perforating torch 100 when activated and may allow for a more even filling of perforating head assembly 171 and thereby to cleaner and more uniform perforations.

In some embodiments, ports 179 may be angled upward such as, for example and without limitation, up to 45 degrees. In the upward angled port configuration, exhaust gasses may act as an anchoring mechanism keeping perforating torch 100 stationary during initiation. The exhaust gas is forced upward creating downward pressure on the tool, thereby anchoring perforating torch 100 in place within the wellbore. Such anchoring may, for example and without limitation, allow perforating torch 100 to perforate or cut the tubular without the need to perforate the pipe above an obstruction below perforating torch 100 and without the use of a secondary anchoring device.

Figure 6C:
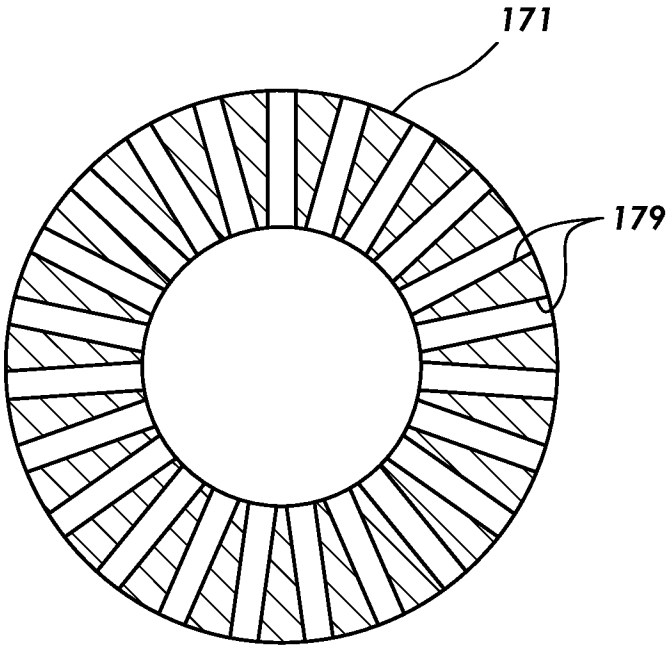
FIG. 6C is a cross section view of an alternative embodiment of the perforating torch of FIG. 6.
Figure 8A:
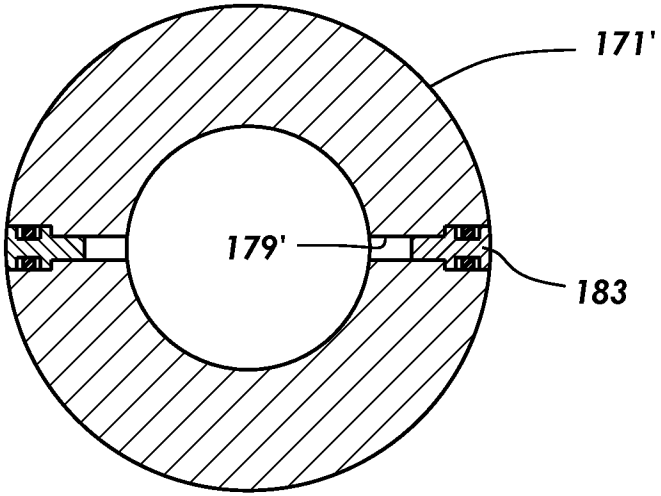
FIG. 8A is a cross section view of the perforating head assembly of FIG. 8.

In some embodiments, as shown in FIG. 6A, perforating head assembly 171 may include ports 179 positioned to perforate a tubular within which perforating torch 100 is positioned such that one or more holes are formed in the tubular. Although four ports 179 are shown, any number of ports 179 may be included in perforating head assembly 171. In some embodiments, such as shown in FIG. 6C, a sufficient number of ports 179 may be formed in perforating head assembly 171 such that a sufficient number of holes are formed in the tubular such that the tubular may be fully severed.

Figure 7:
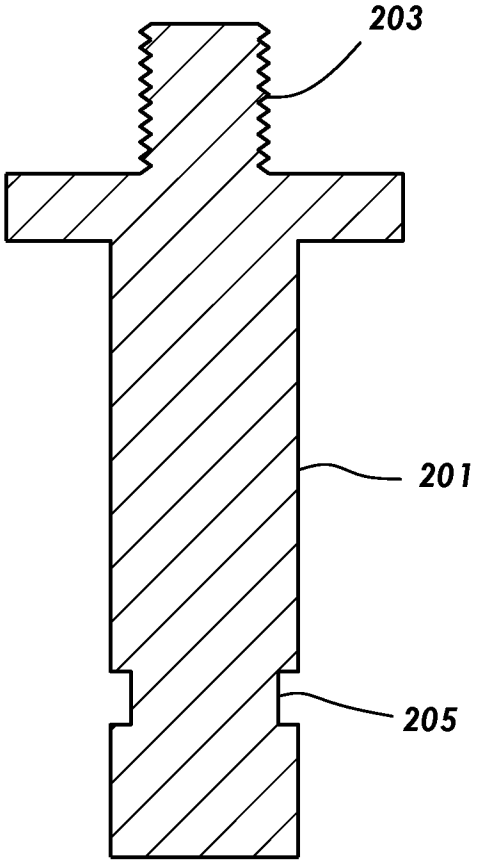
FIG. 7 is a side view of an anchor base consistent with at least one embodiment of the present disclosure.

FIG. 7 shows anchor base 201. In some embodiments, anchor base 201 may be manufactured from hardened steel. Anchor base 201 may be connected to the perforating head assembly 171 by male mechanical threads 203. Near the base of anchor base 201 is a groove 205 that incorporates a stabilizer bar that may, for example and without limitation, reduce the ability of a gas bubble produced by the ignition of the thermite pellets to get beneath and raise perforating torch 100. The stabilizer bar in addition to the angled ports is significant enough to keep the tool stable during initiation.

Figure 8:
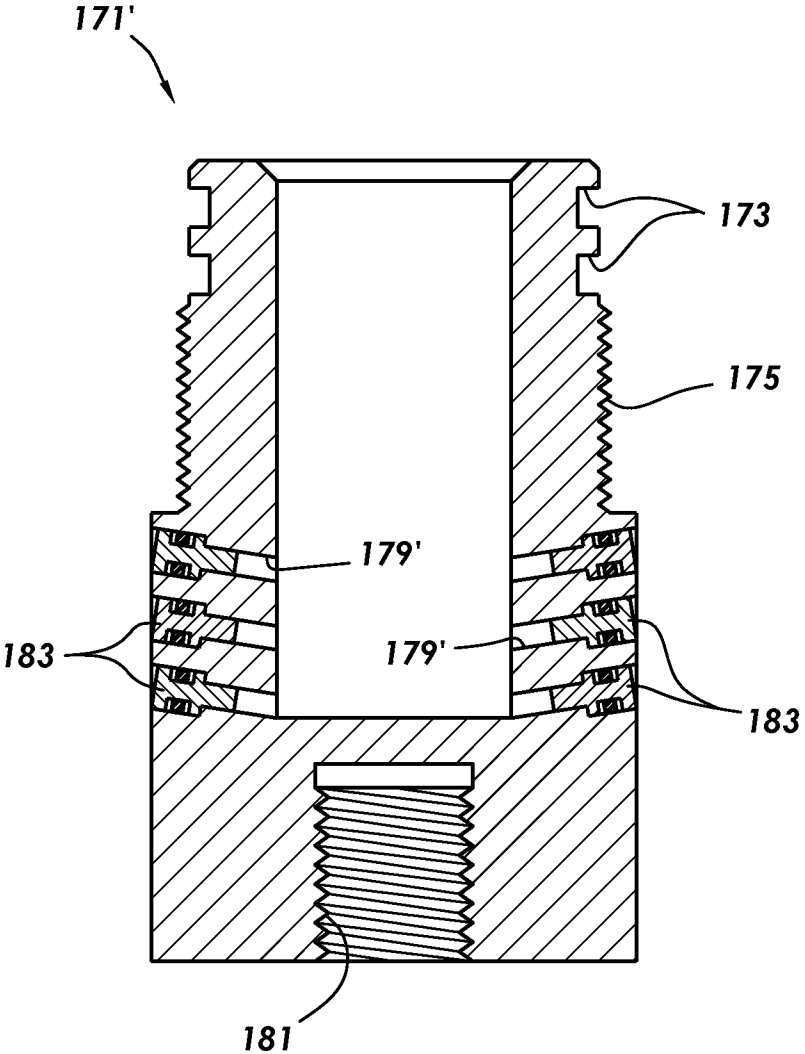
FIG. 8 is a cross section view of a perforating head assembly consistent with at least one embodiment of the present disclosure.

In some embodiments, as shown in FIG. 8, each individual port 179' of perforating head assembly 171' may include port plug 183, which may seal the interior of perforating head assembly 171 from external pressure and may disintegrate or be ejected when perforating torch 100 is activated. In some embodiments, perforating head assembly 171' may include one or more O-ring grooves 173 that incorporate one or more O-rings sealing external pressure from entering the tool before initiation. In some embodiments, perforating head assembly 171' may include male threads 175 allowing for a connection to compressed grain magazine 151. In some embodiments, perforating head assembly 171" may include a hole with female threads 181 formed at a base thereof which may be used to attach anchor base 201. In some embodiments, perforating head assembly 171' may be constructed from refractory metal or alloys of refractory metals.

Figure 9:
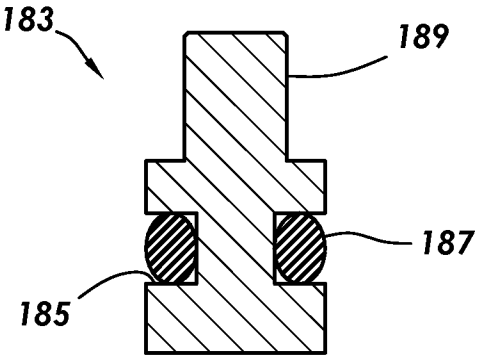
FIG. 9 is a cross section view of a port plug consistent with at least one embodiment of the present disclosure.

FIG. 9 depicts port plug 183. Port plug 183 may be machined from metal such as aluminum or steel. The top of port plug 183 may have a larger diameter than the base. Port plug 183 may include O-ring groove 185 machined into the larger end, which may house O-ring 187, which may, for example and without limitation, seal port 179 from external pressure as discussed above. The base of port plug 183 may have a smaller diameter 189 allowing for a ledge that is the anchoring point for the plug. Port plug 183 may be designed to be forced out of port 179 when perforating torch 100 is activated by the exhaust exiting through port 179. In some embodiments, port plug 183 may be obliterated by the exhaust exiting the perforating torch 100.

Figure 10A:
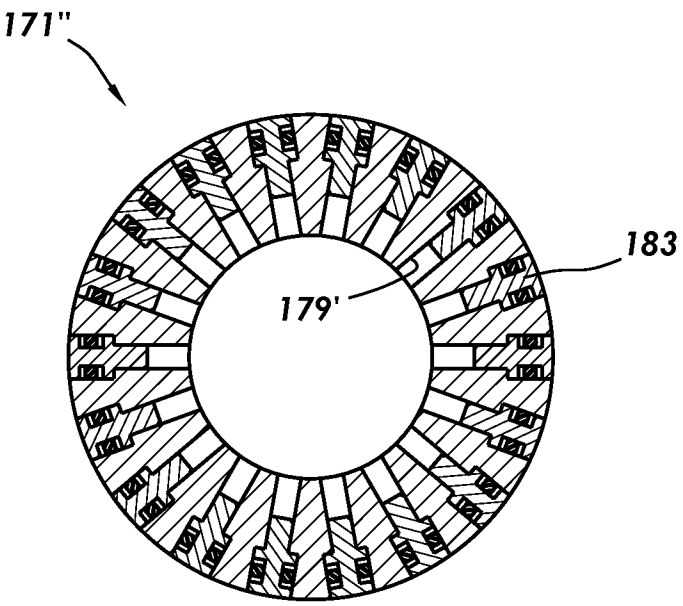
FIG. 10A is a cross section view of the perforating head assembly of FIG. 7.
Figure 10:
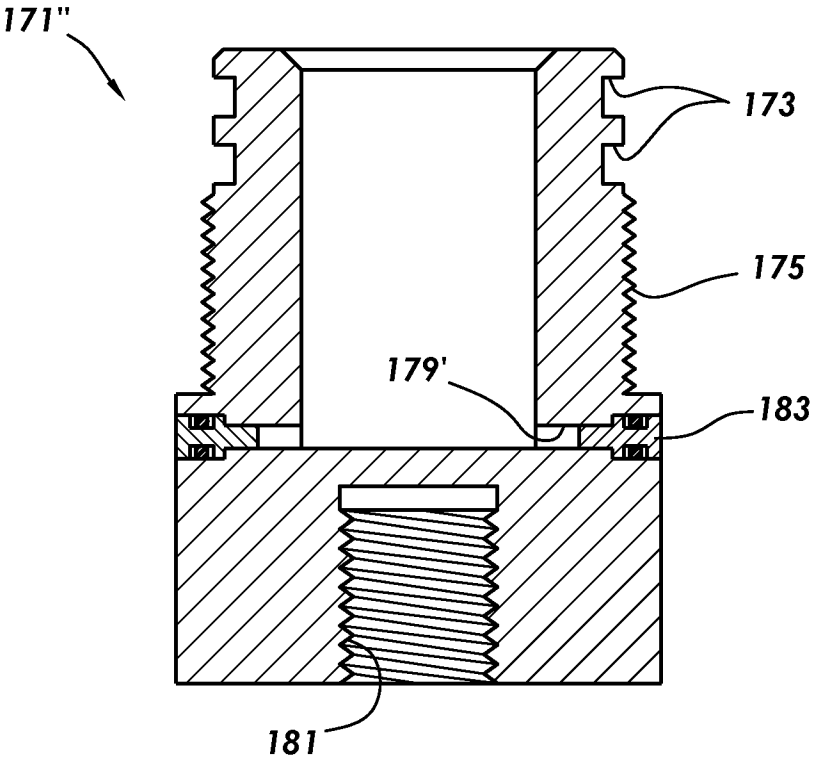
FIG. 10 is a cross section view of a perforating head assembly consistent with at least one embodiment of the present disclosure.

FIGS. 10, 10A show another embodiment of perforating head assembly 171". Perforating head assembly 171" may include a plurality of radially arranged ports 179'. In some embodiments, each port 179' may include port plug 183. Ports 179' may be machined at a 0 degree horizontal plane or up to a 45 degree upward angle. In the upward angled port configuration, exhaust gasses may act as an anchoring mechanism keeping perforating torch 100 stationary during initiation. The exhaust gas is forced upward creating downward pressure on the tool.

In some embodiments, perforating head assembly 171" may include a sufficient number of ports 179' such that actuation of perforating torch 100 acts to sever the pipe in two.

Figure 11:
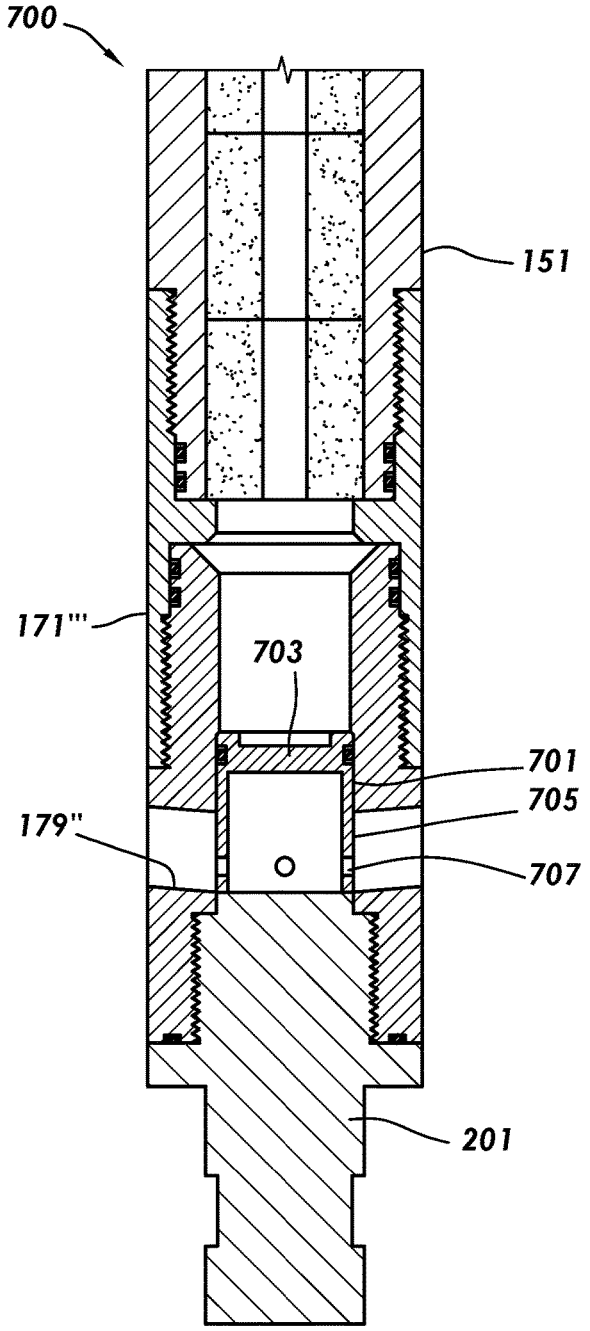
FIG. 11 is a cross section view of a perforating torch consistent with at least one embodiment of the present disclosure.
Figure 11A:
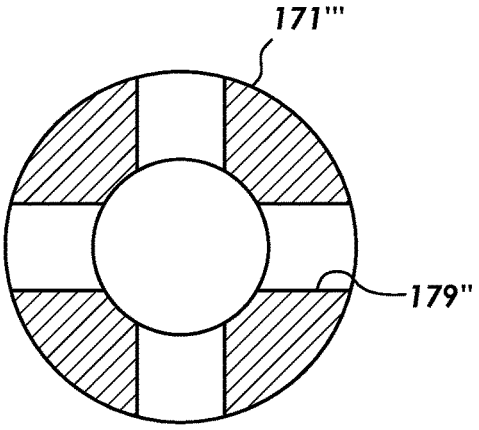
FIG. 11A is a cross section view of the perforating torch of FIG. 11.
Figure 11B:
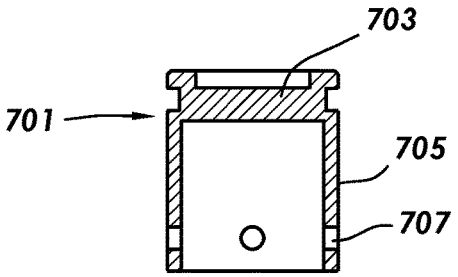
FIG. 11B is a cross section view of a rupture cup consistent with at least one embodiment of the present disclosure.

In some embodiments, as shown in FIGS. 11, 11A, 11B, perforating head assembly 171' may include rupture cup 701. Rupture cup 701 may incorporate rupture disc 703 and gun tube 705. The interior of gun tube 705 may be sealed from compressed grain magazine 151 by rupture disc 703. When perforating torch 700 is activated, the molten combustible material may be forced to melt through rupture disc 703, which may build back pressure within perforating head assembly 171' such that, when rupture disc 703 ruptures, the pressure within gun tube 705 may be higher, thereby allowing for even distribution of the jet through multiple ports 707 formed in gun tube 705 and thence through ports 179" formed in perforating head assembly 171', thus perforating the pipe evenly. Ports 707 and the inside diameter of perforating head assembly 171'" below the top of rupture disc 703 may be filled with well fluid that may also aid in even distribution of the molten combustible material through ports 707.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A perforating torch comprising:

a thermal igniter assembly;

a compressed grain magazine, the compressed grain magazine coupled to the thermal igniter; and a perforating head assembly coupled to the compressed grain magazine, the perforating head assembly including a port, wherein the port is angled upward toward the top of the perforating torch.

2. The perforating torch of claim 1, further comprising a rupture disc positioned between the compressed grain magazine and the perforating head assembly, the rupture disc adapted to fail mechanically once the perforating torch is activated.

3. The perforating torch of claim 1, wherein the port is angled between 1° to 45°.

4. The perforating torch of claim 1, wherein the compressed grain magazine comprises a magazine housing and a compressed nonexplosive combustible material positioned therein.

5. The perforating torch of claim 4, wherein the compressed nonexplosive combustible material is thermite.

6. The perforating torch of claim 4, wherein the compressed nonexplosive combustible material is wrapped in a film.

7. The perforating torch of claim 6, wherein the film is fluorinated ethylene propylene shrink tubing.

8. The perforating torch of claim 4, wherein the compressed grain magazine comprises a compression disc positioned at each end of the magazine housing, wherein each compression disc includes one or more compression disc holes formed therein.

9. The perforating torch of claim 1, wherein the thermal igniter assembly comprises a cartridge containment sub, a thermal igniter, and a thermal cartridge.

10. The perforating torch of claim 9, wherein the thermal cartridge comprises a cartridge housing and a nonexplosive combustible material positioned therein.

11. The perforating torch of claim 10, wherein the nonexplosive combustible material is loose powdered thermite.

12. The perforating torch of claim 10, wherein the cartridge housing includes an outer housing, a top cap, and a bottom cap, wherein the top cap includes at least one center hole formed therein and the bottom cap includes at least one hole formed therein.

13. The perforating torch of claim 9, wherein the thermal igniter comprises a heating coil assembly.

14. The perforating torch of claim 1, wherein the thermal igniter assembly comprises an electrical sub.

15. A perforating torch comprising:

a thermal igniter assembly;

a compressed grain magazine, the compressed grain magazine coupled to the thermal igniter;

a perforating head assembly coupled to the compressed grain magazine, the perforating head assembly including a port; and a rupture disc positioned between the compressed grain magazine and the perforating head assembly, the rupture disc adapted to fail mechanically once the perforating torch is activated, wherein the perforating head assembly is filled with wellbore fluid while the rupture disc is intact.

16. A perforating torch comprising:

a thermal igniter assembly;

a compressed grain magazine, the compressed grain magazine coupled to the thermal igniter;

a perforating head assembly coupled to the compressed grain magazine, the perforating head assembly including a port; and a port plug positioned within the port, the port plug including one or more O-rings positioned to seal against the port of the perforating head assembly, the port plug adapted to be forced out of port 179 when the perforating torch is activated.

17. A method comprising:

positioning a perforating torch in a casing or tubular desired to be perforated or severed, the perforating torch including:

a thermal igniter assembly, the thermal igniter assembly including a cartridge containment sub, a thermal igniter, and a thermal cartridge, the thermal cartridge including a cartridge housing and a nonexplosive combustible material positioned therein;

a compressed grain magazine, the compressed grain magazine coupled to the thermal igniter, the compressed grain magazine including a magazine housing and a compressed nonexplosive combustible material positioned therein; and a perforating head assembly coupled to the compressed grain magazine, the perforating head assembly including a port, wherein the port is angled upward toward the top of the perforating torch;

activating the thermal igniter;

igniting the nonexplosive combustible material of the thermal cartridge;

igniting the compressed nonexplosive combustible material of the compressed grain magazine with exhaust gases of the nonexplosive combustible material of the thermal cartridge;

expelling exhaust gases of the compressed nonexplosive combustible material of the compressed grain magazine through the port of the perforating head assembly; and forming an aperture in the casing or tubular using the exhaust gases expelled through the port.

18. The method of claim 17, wherein the perforating torch further comprises a rupture disc positioned between the compressed grain magazine and the perforating head assembly, wherein the method further comprises, after igniting the compressed nonexplosive combustible material:

building pressure within the compressed grain magazine; and rupturing the rupture disc.

19. The method of claim 17, wherein the method further comprises anchoring the perforating torch within the tubular or casing by a resultant downward force caused by the upward expulsion of the exhaust gases through the angled port.

20. The method of claim 17, further comprising wrapping multiple elements of the compressed nonexplosive combustible material in a film before positioning the compressed nonexplosive combustible material in the magazine housing.

21. A method comprising:

positioning a perforating torch in a casing or tubular desired to be perforated or severed, the perforating torch including:

a thermal igniter assembly, the thermal igniter assembly including a cartridge containment sub, a thermal igniter, and a thermal cartridge, the thermal cartridge including a cartridge housing and a nonexplosive combustible material positioned therein;

a compressed grain magazine, the compressed grain magazine coupled to the thermal igniter, the compressed grain magazine including a magazine housing and a compressed nonexplosive combustible material positioned therein;

a perforating head assembly coupled to the compressed grain magazine, the perforating head assembly including a port; and a rupture disc positioned between the compressed grain magazine and the perforating head assembly, allowing wellbore fluid from the casing or tubular to enter the perforating head assembly through the port prior to the rupturing of the rupture disc;

activating the thermal igniter;

igniting the nonexplosive combustible material of the thermal cartridge;

igniting the compressed nonexplosive combustible material of the compressed grain magazine with exhaust gases of the nonexplosive combustible material of the thermal cartridge;

building pressure within the compressed grain magazine;

rupturing the rupture disc expelling exhaust gases of the compressed nonexplosive combustible material of the compressed grain magazine through the port of the perforating head assembly; and forming an aperture in the casing or tubular using the exhaust gases expelled through the port.

22. A compressed nonexplosive combustible material for use in a cutting torch comprising:

one or more pellets of compressed nonexplosive combustible material; and a film wrapped around the one or more pellets of compressed nonexplosive combustible material, wherein the film is fluorinated ethylene propylene shrink tubing.

* * * * *